United States Patent [19]

DeBruyn

[11] Patent Number: 4,639,051

[45] Date of Patent: Jan. 27, 1987

[54] TURN-OUT SHELF ASSEMBLY FOR A CABINET

[75] Inventor: William DeBruyn, Rockford, Ill.

[73] Assignee: Amerock Corporation, Rockford, Ill.

[21] Appl. No.: 715,881

[22] Filed: Mar. 25, 1985

[51] Int. Cl.[4] ..... A47B 81/00

[52] U.S. Cl. ..... 312/275; 312/329

[58] Field of Search ..... 312/275, 326, 329, 26, 312/271, 298, 300, 269

[56] References Cited

U.S. PATENT DOCUMENTS

| | | | |
|---|---|---|---|
| 589,463 | 9/1897 | Case | 312/329 |
| 1,899,711 | 2/1933 | Warren | 312/275 |
| 2,111,411 | 3/1938 | Spreen | 312/275 |
| 2,457,248 | 12/1948 | Lemke | 312/329 |

OTHER PUBLICATIONS

Pages 1, 2, 3, 10, 11, 18 and 19 of a catalog published by Scovill, Inc. in 1980 and entitled *Nutone Adjax Rev-A--Shelf Cabinet Storage Organizers.*

Six page brochure entitled "The Alternative", published by FGV America, publication date unknown.

Seven pages from a catalog published by Feeny Manufacturing Co., Inc., publication date estimated to be about 1982.

Cover page, pp. 9, 10, 11 and 12 from a catalog published in 1981 by Hafele America Company.

*Primary Examiner*—Kenneth J. Dorner
*Assistant Examiner*—Gerald A. Anderson
*Attorney, Agent, or Firm*—Leydig, Voit & Mayer

[57] ABSTRACT

Upper and lower shelves are supported on a rotatable post in a cabinet to turn outwardly about the axis of the post from a stored position to an accessible position, the lower shelf being turned out automatically when the door of the cabinet is opened. The lower shelf is mounted to turn relative to the post while the upper shelf is mounted to turn with the post so as to enable the lower shelf to turn outwardly independently of the upper shelf and to enable the use of a simple lower bearing element for rotatably supporting both the post and the lower shelf.

3 Claims, 12 Drawing Figures

TURN-OUT SHELF ASSEMBLY FOR A CABINET

BACKGROUND OF THE INVENTION

This invention relates generally to a rotatable shelf assembly for a cabinet and relates more particularly to a shelf assembly of the type in which upper and lower shelves are adapted to be turned out of the cabinet from a stored position to an accessible position. When each shelf is in its accessible position, at least part of the shelf is located outside of the cabinet to facilitate placing articles on and removing articles from the shelf.

The lower shelf may be linked to the door of the cabinet so as to turn out automatically to its accessible position when the door is swung to its open position. The upper shelf turns independently of the lower shelf and either may be manually turned outwardly into overhanging relation with the lower shelf or may be left in the cabinet to avoid creating an overhead obstruction above the lower shelf.

SUMMARY OF THE INVENTION

The general aim of the present invention is to provide a new and improved shelf assembly which, when compared with prior assemblies of the same general type, is relatively simple in construction and whose components may be assembled and then installed in the cabinet in a quicker and easier manner.

A more detailed object of the invention is to achieve the foregoing by providing a shelf assembly in which both shelves rotate about the axis of a rotatable support post with one shelf being supported to rotate in unison with the post and with the other shelf being supported to rotate relative to the post.

The invention also resides in the provision of a novel bearing assembly which supports the post for rotation in the cabinet, supports the lower shelf for rotation on the post and holds the post against rotation when the lower shelf is being rotated on the post.

These and other objects and advantages of the invention will become more apparent from the following detailed description when taken in conjunction with the accompanying drawings.

DETAILED DESCRIPTION OF THE PREFERRED EMBODIMENT

Figure 2:
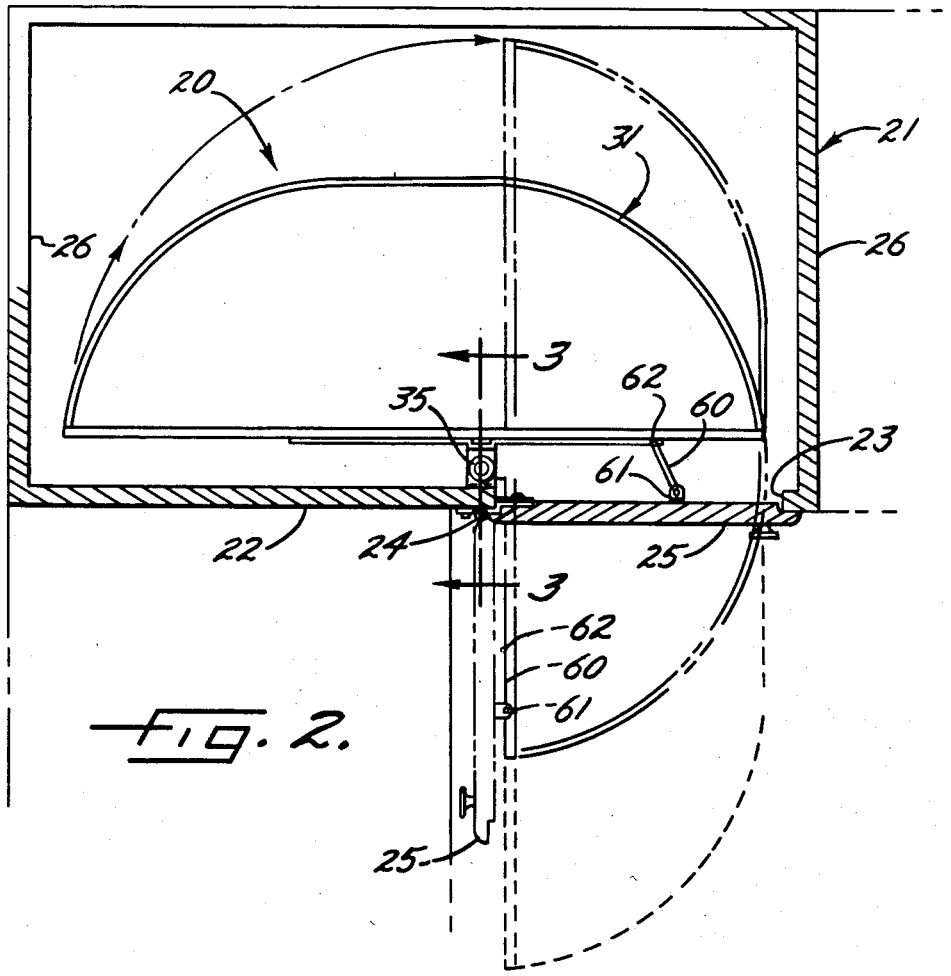
FIG. 2 is a cross-section taken horizontally through the cabinet and showing the door in a closed position.
Figures 3, 4, 5, 6:
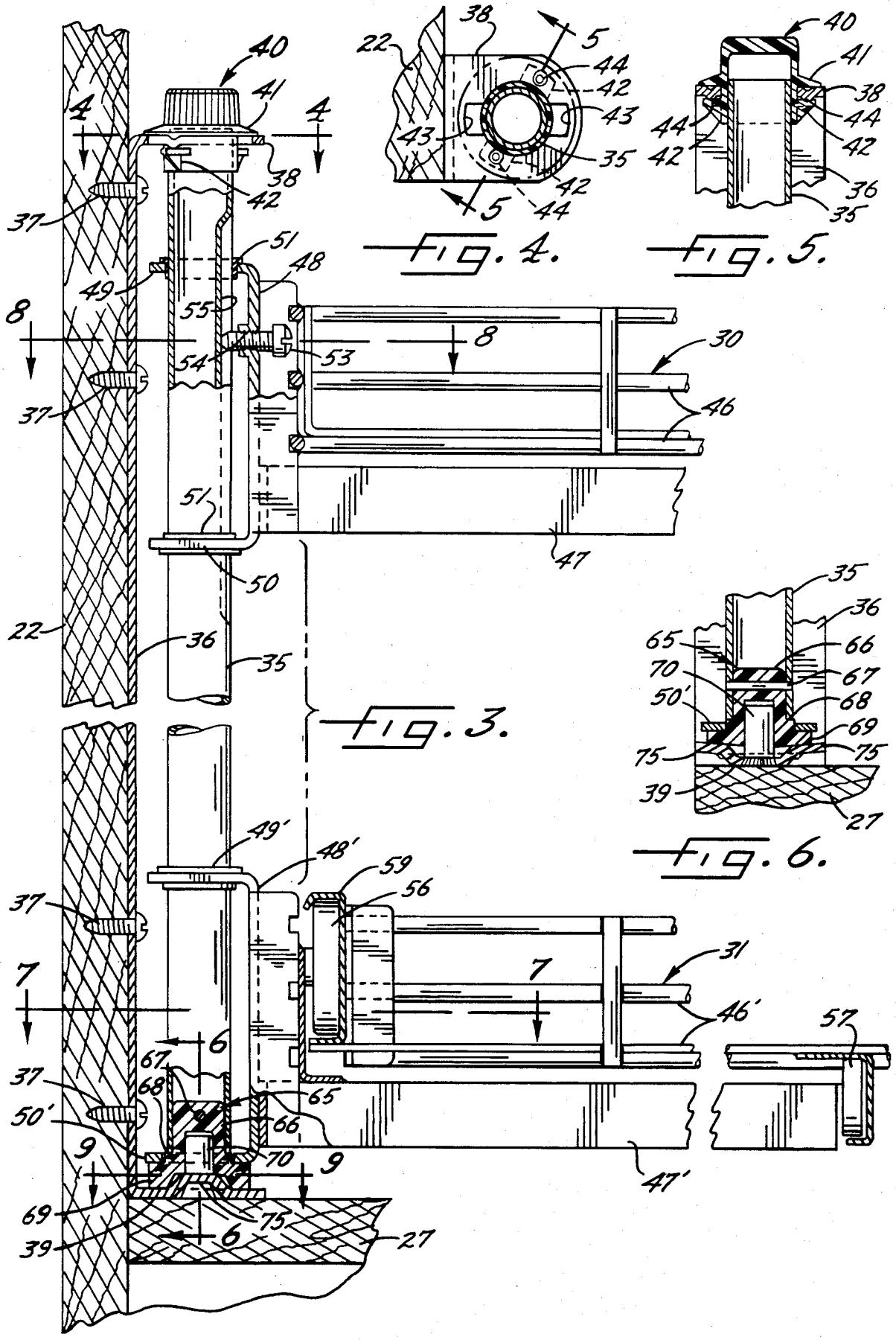
FIG. 3 is an enlarged fragmentary cross-section taken substantially along the line 3—3 of FIG. 2.
FIG. 4 is a fragmentary cross-section taken substantially along the line 4—4 of FIG. 3.
FIG. 5 is a fragmentary cross-section taken substantially along the line 5—5 of FIG. 4.
FIGS. 6, 7 and 8 are fragmentary cross-sections taken substantially along the lines 6—6, 7—7 and 8—8, respectively, of FIG. 3.
Figure 7:
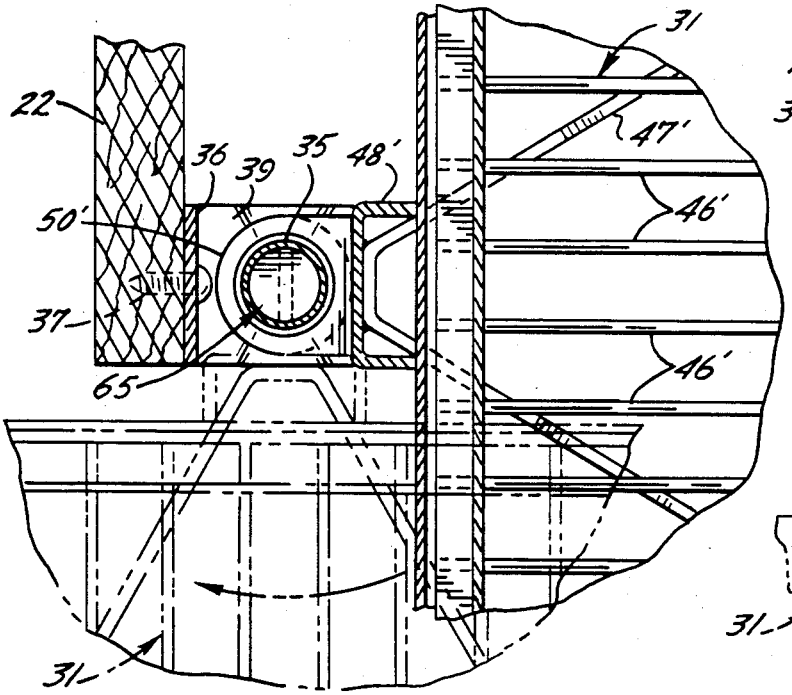

For purposes of illustration, the invention is shown in the drawings in connection with a rotatable shelf assembly 20 adapted for installation in a kitchen cabinet 21. The cabinet which has been illustrated is a blind corner base cabinet having a front wall 22 with a laterally offset front opening 23. Hinged at 24 adjacent one side of the opening is a door 25 which is adapted to be swung between open and closed positions. The cabinet also includes the usual side walls 26 (FIG. 2) and a bottom wall 27 (FIG. 3).

Upper and lower vertically spaced shelves 30 and 31 which are generally elliptical in shape are supported in the cabinet 21 to turn between stored and accessible positions. When in their stored positions, both shelves are disposed completely inside of the cabinet and are located as shown in solid lines in FIG. 2. By turning the shelves clockwise through ninety degrees, the shelves may be turned outwardly to accessible positions in which at least the outer portion of each shelf projects outwardly from the cabinet as shown in dot-dash lines in FIG. 2 to enable ready access to articles on the shelf. As will be explained subsequently, the lower shelf 31 also may be rolled outwardly relative to the open door 25 to a position in which virtually the entire lower shelf is disposed completely out of the cabinet as shown in dotted lines in FIG. 2.

In the present instance, the lower shelf 31 is connected to the door 25 so as to be automatically turned outwardly from the cabinet 21 when the door is swung to its open position. The upper shelf 30 rotates independently of the lower shelf and remains in the cabinet during opening of the door so as to not obstruct access to the lower shelf. When access to the upper shelf is desired, the upper shelf may be turned outwardly to a position overhanging the lower shelf.

In accordance with the present invention, both of the shelves 30 and 31 are supported to rotate about the axis of a rotatable post 35, one of the shelves rotating in unison with the post while the other shelf rotates on or relative to the post. This arrangement allows the two shelves to turn independently of one another and, as will become apparent, simplifies assembly of the shelves to the post, simplifies installation of the overall shelf assembly 20 in the cabinet 21 and enables the use of a simplified bearing structure for the lower shelf and the lower end of the post.

More specifically, the post 35 is tubular, is made of metal and is supported to turn about a vertical axis located adjacent the hinge side of the front opening 23 and spaced rearwardly or inwardly from the hinge axis 24 of the door 25. To support the post 35, a U-shaped mounting bracket 36 (FIG. 3) made of metal is attached to the inner side of the front wall 22 by screws 37 and is formed with upper and lower inwardly projecting flanges 38 and 39. An upper bearing member or cap 40 (FIGS. 3 to 5) made of plastic is fixed within a hole in the upper flange 38 and rotatably receives an upper bearing element which herein is the extreme upper end portion of the post 35. The cap is formed with a radially extending skirt 41 adapted to engage the upper side of the flange 38. The lower end portion of the cap is formed with two radially extending and diametrically spaced ears 42 spaced below the skirt 41 and sized to extend through complemental slots 43 formed in the flange 38 adjacent the hole therein.

After the upper end portion of the post 35 has been placed loosely through the hole in the flange 38, the bearing cap 40 is inserted downwardly into the hole and is telescoped onto the upper end portion of the post, the ears 42 passing downwardly through the slots 43. Thereafter, the cap is turned through 45 degrees to the position shown in FIG. 4 to move the ears out of alinement with the slots and beneath the flange 38 and to cause the ears to coact with the skirt 41 to captivate the bearing cap 40 vertically in the hole in the flange 38. When the cap is turned to the position shown in FIG. 4, small detent nibs 44 (FIG. 5) projecting downwardly from the lower side of the flange 38 snap into complemental pockets in the upper sides of the ears to hold the cap releasably against turning. The inner wall of the plastic cap closely receives the upper end portion of the post 35 but permits the post to turn with relatively friction-free motion.

Figure 1:
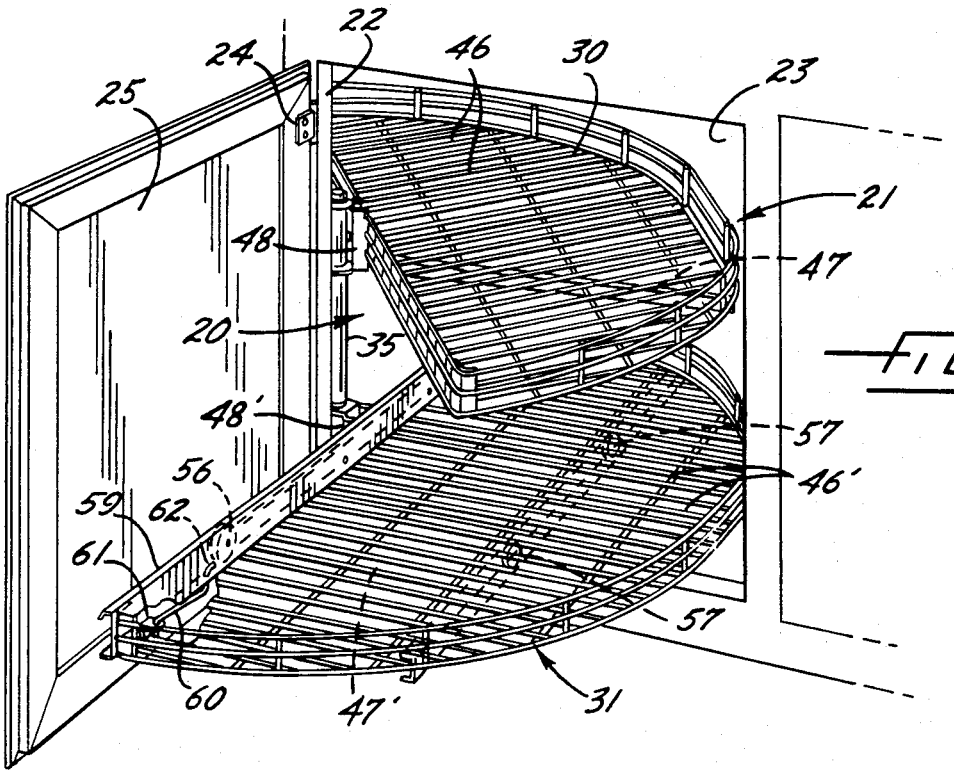
FIG. 1 is a perspective view of a typical cabinet equipped with a new and improved rotary shelf assembly incorporating the unique features of the present invention, the door of the cabinet being shown in an open position and the upper shelf being shown in a partially turned-out position.

The upper shelf 30 includes a wire basket 46 (FIGS. 1 and 3) which is supported by a framework 47. Secured rigidly to the framework is a U-shaped mounting bracket 48 (FIG. 3) having upper and lower flanges 49 and 50 fitted with plastic bushings 51 which are telescoped snugly but slidably with the post 35. A set screw 53 is threaded into a hole 54 in the bracket 48 and extends into a vertically elongated channel 55 depressed inwardly from one side of the post. Thus, the screw locks the upper shelf 30 for rotation in unison with the post 35 while enabling the shelf to be adjusted vertically along the post.

As shown in FIG. 3, the lower shelf 31 is similar to the upper shelf 30 in that the lower shelf includes a basket 46', a framework 47' and a U-shaped mounting bracket 48' with upper and lower flanges 49' and 50'. In the case of the lower shelf, however, the framework 47' carries rollers 56 and 57 which coact with channel-like tracks 58 and 59, respectively, on the basket 46' to support the basket for in-and-out sliding on the framework between the position shown in dotted lines and the position shown in dot-dash lines in FIG. 2. Also, the lower shelf 31 is adapted to be turned between its stored and accessible positions when the door 25 is swung between its closed and open positions. For this purpose, a wire link 60 (FIG. 2) is pivotally connected at 61 to the inner side of the door 25 and is connected at 62 to the lower shelf. The link causes the shelf to turn automatically in response to swinging of the door.

In keeping with the invention, the lower shelf 31 is supported to rotate on or relative to the post 35 so that, whenever the door 25 is opened to turn the lower shelf outwardly, the post remains stationary to keep the upper shelf 30 in the cabinet 21 and avoid obstructing the outwardly turned lower shelf with the upper shelf. If it then is desired to turn the upper shelf outwardly, the upper shelf is simply rotated manually and, as an incident thereto, the post 35 turns relative to the lower shelf 31.

To mount the lower shelf 31 for rotation relative to the post 35, the upper flange 49' of the mounting bracket 48' is fitted with a plastic bushing 51' (FIG. 3) similar to the bushings 51 and supporting the upper flange 49' rotatably on the post. The lower flange 50' of the mounting bracket 48', however, is fitted with a unique bearing element 65 which not only supports the lower flange 50' to rotate relative to the post but also supports the post to rotate on the lower flange 39 of the main mounting bracket 36.

As shown in FIGS. 3 and 6, the lower bearing element 65 is made of plastic and includes an upper plug portion 66 which is telescoped snugly into the lower end portion of the post 35. A roll pin 67 extends radially through the post and the plug portion 66 to anchor the bearing element 65 tightly to the post.

Located below and formed integrally with the plug portion 66 of the lower bearing element 65 and butting against the extreme lower end of the post 35 is an intermediate bearing portion 68 which is somewhat larger in diameter than the plug portion. The lower flange 50' of the lower mounting bracket 48' is rotatably journaled on the intermediate bearing portion 68 and rests on a lower bearing portion 69 on the lower end of and somewhat larger in diameter than the intermediate portion. A lower bearing member in the form of a trunnion 70 is fixed rigidly to the lower flange 39 of the main mounting bracket 36 and projects upwardly into a hole in the bearing element 65 with a rotatable fit. Thus, the bearing element 65 supports the post 35 to rotate on the main mounting bracket 36 while supporting the lower mounting bracket 48' of the lower shelf 31 to rotate on the post.

Figure 9:
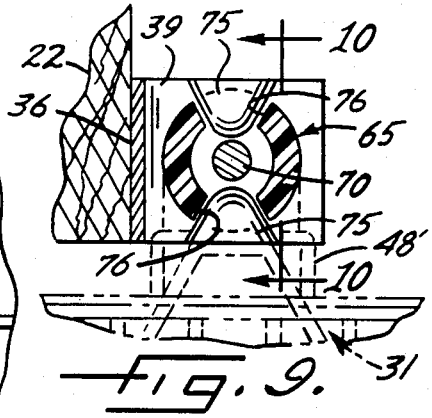
FIG. 9 is a fragmentary cross-section taken substantially along the line 9—9 of FIG. 3 and shows the lower bearing assembly of the post as positioned when the upper shelf is in its stored position.
Figure 10:
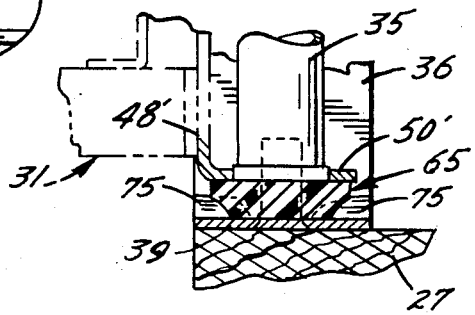
FIG. 10 is a fragmentary cross-section taken substantially along the line 10—10 of FIG. 9.
Figure 8:
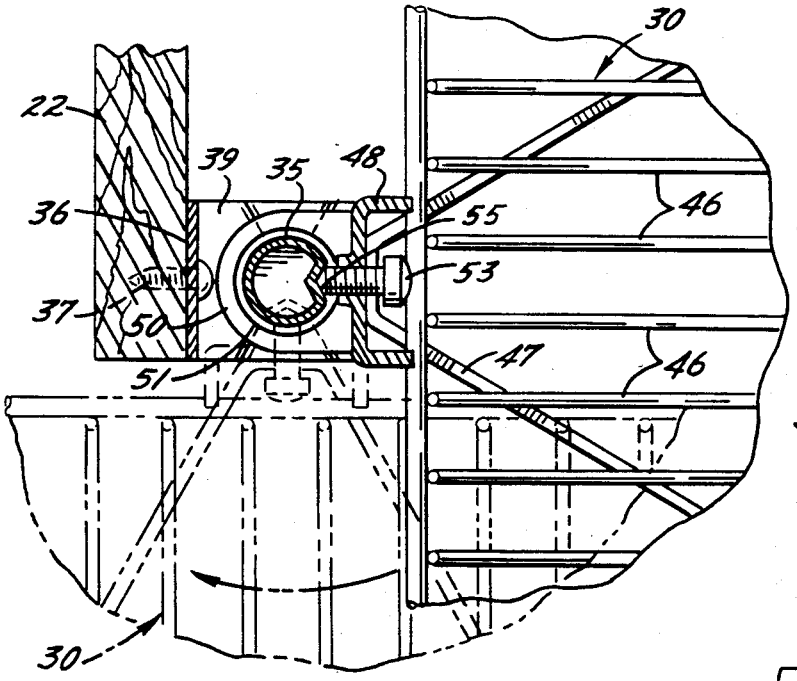
Figure 11:
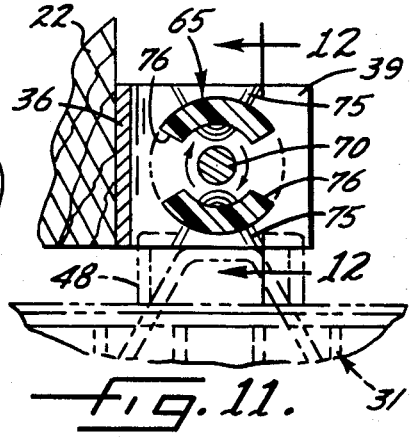
FIG. 11 is a view similar to FIG. 9 but shows the lower bearing assembly of the post as positioned when the upper shelf is turned outwardly to its accessible position.
Figure 12:
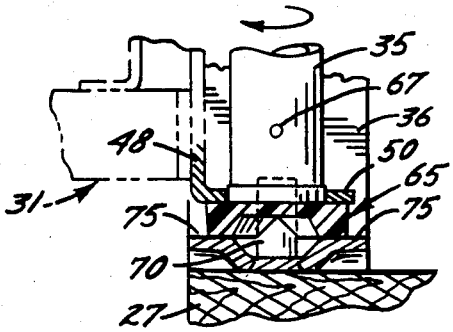
FIG. 12 is a fragmentary cross-section taken substantially along the line 12—12 of FIG. 11.

Although the lower shelf 31 rotates on the post 35, friction between the lower shelf and the post may tend to rotate the post when the lower shelf is automatically turned during swinging of the door 25. To prevent such undesirable rotation of the post, detent means on the lower bearing element 65 and the lower flange 39 of the mounting bracket 36 coact to hold the post releasably in a stationary position. Herein, the detent means include a pair of diametrically spaced and generally V-shaped lugs 75 (FIG. 10) projecting upwardly from the upper side of the flange 39 and sized to fit within a pair of complemental pockets 76 (FIG. 12) formed in the lower face of the bearing element 65. When the upper shelf 30 is in its stored position, the lugs 75 seat within the pockets 76 as shown in FIGS. 9 and 10 and engage the ends thereof to prevent friction from rotating the post 35 when the lower shelf 31 is turned. When the upper shelf 30 is manually turned outwardly, substantial torque is applied to the post and overcomes the holding action of the lugs 75. Thus, the pockets 76 cam past the lugs as shown in FIGS. 11 and 12 and allow turning of the post and the upper shelf. As the pockets cam past the lugs, the lower surface of the bearing element 65 rides onto the top of the lugs (see FIG. 12) and causes the post 35 to move upwardly a short distance. The pockets 76 reseat on the lugs 75 when the upper shelf 30 is returned toward its stored position and thus coact with the lugs to establish the stored position of the upper shelf.

Assembly of the shelves 30 and 31 to the post 35 and installation of the entire shelf assembly 20 in the cabinet 21 can be accomplished quickly and easily. First, the lower shelf 31 is slipped downwardly over the upper end of the post 35 and is lowered downwardly until the lower flange 50' slips over and is journaled by the intermediate portion 68 of the lower bearing element 65. Thereafter, the upper shelf 30 is slipped downwardly over the upper end of the post and is locked in place by the set screw 53. After the mounting bracket 36 has been installed in the cabinet 21, the post and shelf assembly is tilted to insert the upper end portion of the post through the hole in the upper flange 38 of the main mounting bracket 36 and then is returned to a vertical position and lowered to cause the lower bearing element 65 to telescope onto the trunnion 70. The upper bearing cap 40 then is installed in the manner described previously after which the link 60 is connected between the door 25 and the lower shelf 31 to complete the installation.

I claim:

1. A rotary shelf assembly for a cabinet having a front opening and having a vertically extending door hinged adjacent one side of said opening to swing between closed and open positions about a vertical axis, said shelf assembly comprising a vertically extending post, means supporting said post within said cabinet to turn about a vertical axis located adjacent said one side of said opening and offset rearwardly from the axis of said door, an upper shelf supported on said post to turn in unison with said post about the axis of the post between stored and accessible positions, a lower shelf supported on the post to turn relative to the post about the axis of the post between stored and accessible positions, each shelf being located within the cabinet when the shelf is in its stored position and being at least partially located outside of the cabinet when the shelf is in its accessible position, means connecting said door to said lower shelf for causing said lower shelf to turn automatically between its stored and accessible positions as said door is swung between its closed and open positions, and releasable means holding said post against rotation when said lower shelf is turned while permitting rotation of said post when said upper shelf is turned.

2. A rotary shelf assembly as defined in claim 1 in which said lower shelf is supported to roll inwardly and outwardly relative to said door when the door is in its open position.

3. A rotary shelf assembly for a cabinet having a bottom wall, having a front opening and having a vertically extending door hinged adjacent one side of the opening to swing between closed and open positions about a vertical axis, said shelf assembly comprising a vertically extending post, upper and lower bearing members connected to said cabinet, upper and lower bearing elements on said post and coacting with said upper and lower bearing members, respectively, to support said post within said cabinet to turn about a vertical axis located adjacent said one side of said opening and offset rearwardly from the axis of the door, upper and lower vertically spaced shelves turnable about the axis of the post between stored and accessible positions, each shelf being located within the cabinet when the shelf is in its stored position and being located at least partially outside of the cabinet when the shelf is in its accessible position, means connecting said door to said lower shelf for causing said lower shelf to turn automatically between its stored and accessible positions when said door is swung between its closed and open positions, means connecting said upper shelf to said post to turn in unison with the post, means including said lower bearing element and including a bracket attached to said lower shelf for connecting said lower shelf to said post to turn relative to the post, said lower bearing element being rotatably supported on said lower bearing member adjacent the bottom wall of the cabinet and having an upper portion telescoped non-rotatably into the lower end portion of said post, said lower bearing element having a portion located below said upper portion and rotatably supporting said bracket, and releasable detent means coacting between said lower bearing element and said lower bearing member for holding said lower bearing element and said post against rotation when said lower shelf is turned while permitting rotation of said lower bearing element and said post when said upper shelf is turned.

* * * * *